United States Patent [19]

Dellian et al.

[11] 4,095,942

[45] Jun. 20, 1978

[54] PRINTING OF HYDROPHOBIC TEXTILES WITHOUT AFTERWASH AND PRODUCT THEREOF

[75] Inventors: Kurt A. Dellian, Greensboro; Fernand Schlaeppi, High Point, both of N.C.

[73] Assignee: Ciba-Geigy Corporation, Ardsley, N.Y.

[21] Appl. No.: 665,038

[22] Filed: Mar. 8, 1976

[51] Int. Cl.[2] ..... D06P 5/00; D06P 7/00

[52] U.S. Cl. ..... 8/62; 8/18 R; 8/18 A; 8/21 C; 8/39 C; 8/39 B; 8/41 C; 8/92; 8/173; 8/178 R; 8/179

[58] Field of Search ..... 8/18 A, 62, 173, 18 R, 8/92, 70, 71, 21 C

[56] References Cited

U.S. PATENT DOCUMENTS

| | | | |
|---|---|---|---|
| 1,976,679 | 10/1934 | Fikentscher et al. | 8/18 A |
| 2,215,196 | 9/1940 | Schlack | 8/18 A |
| 3,957,427 | 5/1976 | Chambers | 8/62 |
| 3,977,828 | 8/1931 | Becker et al. | 8/79 |

OTHER PUBLICATIONS

EMA-Ethylene Maleic Anhydride Resins, Monsanto Technical Bulletin IC/SCS-261.

Carbopol Service Bulletin GC-36, revised (Goodrich Chemical Company).

Carbopol Service Bulletin GC-51, (Goodrich Chemical Company).

*Primary Examiner*—A. Lionel Clingman

*Attorney, Agent, or Firm*—Edward McC. Roberts; Prabodh I. Almaula

[57] ABSTRACT

A process for printing synthetic thermoplastic fibers, particularly polyester textiles, by applying to the fibers an aqueous dispersion of a non-ionic organic colorant, particularly a disperse dyestuff, and a thickener, subsequently drying the printed fibers, and finally heating the fibers to fix the colorant, wherein the aqueous dispersion contains less than 1%, preferably 0.2 to 0.5%, of a thickener of the formula

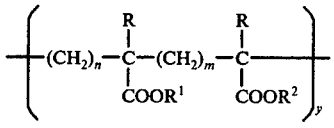

where

R is hydrogen or lower alkyl, $R^1$ and $R^2$ are hydrogen, sodium, potassium, ammonium, mono-lower alkyl ammonium, di-lower alkyl ammonium, tri-lower alkyl ammonium, or tetra-lower alkyl ammonium, m is 0 or 1, n is 2 - m, and y is 5000 to 50,000.

Textiles printed by this process do not require any soaping or afterwash to remove the thickener and any unfixed dyestuff in order to have full shade printings with excellent fastness properties.

12 Claims, No Drawings

PRINTING OF HYDROPHOBIC TEXTILES WITHOUT AFTERWASH AND PRODUCT THEREOF

BACKGROUND OF THE INVENTION

Aqueous printing pastes, for use in printing and dyeing thermoplastic fiber material, such as polyester textiles, have of necessity contained thickening agents in order to be sufficiently thick and non-flowing for proper application to the textile material. When heat is used, as is common with thermoplastic textiles, to fix the dyestuff on and in the fibers, many thickening agents of the art discolor and give a finished product having yellowed or muddy color values. Furthermore, thickening agents as used in the art, tend to retain dyestuff which was intended for the fibers. This retention of dyestuff by the thickening agent leads to reduced color yield on the fibers and to poor fastness properties, particularly poor crock fastness, poor bleed fastness, and poor wash fastness on first wash. Finally, thickening agents as used in the art lend a great deal of stiffness to the final product (which is not salable without an afterwash) and generally contribute to poor handle. In summary, thickening agents, as used in the art, are of such a chemical nature and used in such amounts that soaping or afterwash is necessitated or else the finished product will be discolored, have poor fastness properties and poor handle.

Soaping operations are expensive and to be avoided if possible. Not only do soaping operations involve an expenditure of time and materials, but such operations lead to increased plant effluent, which must be treated for ecological reasons. Furthermore, soaping operations involve a large energy expenditure to heat the wash water and dry the washed goods.

The art has addressed the above problems, which are inherent in printing thermoplastic textiles where heat fixation of the dye is practiced, by a number of approaches and improvements to the standard process. The standard process is taught in U.S. Pat. No. 2,663,612, which issued on Dec. 22, 1953 on application of J. W. Gibson, Jr.

One approach to avoiding the above-discussed disadvantages without after-wash is to reduce the amount of high-molecular weight thickener used and still achieve the requisite thickness by inclusion of an emulsified oil in the paste or liquor. That is to say that when the paste or liquor vehicle is a water and oil emulsion instead of water alone, the emulsion itself contributes sufficient thickness that very little high-molecular weight thickening agent is needed, and its removal from the finished product by soaping may be avoided, provided that the high-molecular weight thickening agent is sufficiently heat stable to not give appreciable discoloration during the thermal fixing step. Such an approach is taught in South African Patent No. 70/1414 which issued to H. P. Weber et al. of Mar. 3, 1970. This approach necessitates the removal of the volatile oil thickener and recovering the oil or dealing with the volatized oil as part of the air or water effluent.

A second approach to overcoming the above-discussed problems without after-wash of the final product involves dry thermal transfer printing, also known as sublimation printing. Sublimation or dry thermal transfer printing, taught in French Patent No. 1,223,330 and Swiss Patent No. 476,893, commonly involves the application of a thickened paste, containing sublimable dyestuff, to an auxiliary carrier. The printed auxiliary carrier is then applied to the thermoplastic textile and together with the textile is subjected to heat sufficient to cause the dyestuff to sublime from the carrier to the textile. Any high-molecular weight thickening agent present on the auxiliary carrier remains on the carrier, and the result is a remarkably sharp and clear textile print which requires no after soaping.

An object of this invention is to provide a printing process for use on thermoplastic textile material, involving the direct application of a printing paste to a thermoplastic textile and heat-fixation of the dyestuff on the textile material, to give remarkably sharp and clear prints of good fastness, without discoloration or impaired handle. A further object of this invention is to provide such a printing process without the use of a large amount of water such as is commonly used in soaping operations. Another object of this invention is to provide such a printing process without the use of volatile oils. The avoidance of pollution problems and anti-pollution expenses such as are encountered with large volumes of dyestuff-containing wash waters and with volatile oils, is a further object of this invention.

The objects of this invention have been met by a process for printing synthetic thermoplastic fibers without washing, comprising the steps of applying to the fibers an aqueous dispersion of a non-ionic organic colorant and a high-molecular weight thickener, subsequently drying the fibers, and finally heating the fibers to fix the colorant, wherein the thickener is used in an amount as low as 0.05% but less than 0.5%, preferably 0.05% to 0.2% and most preferably 0.1% to 0.2%, by weight of the aqueous dispersion and wherein the thickener is a compound of the formula:

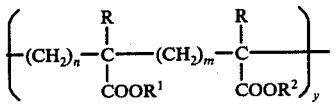

(I)

wherein

R is hydrogen or lower alkyl, $R^1$ and $R^2$ are hydrogen, sodium, potassium, ammonium, mono-lower alkyl ammonium, di-lower alkyl ammonium, tri-lower alkyl ammonium, or tetra-lower alkyl ammonium,

*m* is 0 or 1,

*n* is 2 - m, and

*y* is 5000 to 50,000.

It has been discovered that the thickening agent of formula I are stable to heat, as commonly encountered in the thermal fixation step, and can be used to give thick pastes, even in extremely small amounts. The amount of high-molecular weight thickening agent used in the instant process is of the order of 1/5 to 1/25 of the amount of known-art thickening agents commonly used.

For the thickening agents of this invention to achieve full effectiveness in thickening power, it is advisable that the dyestuff be non-ionic and have no added salt or other electrolyte present. The dyestuff should also be finely divided, that is of colloidal dimensions, generally of a particle size in the range of about 0.5–50 microns in diameter. Dyestuffs for use in this invention can be obtained by milling, particularly wet milling, techniques well-known to the art. Disperse dyestuffs, free of added electrolyte, of the proper particle size are available commercially under the tradename Teraprint, as sold by CIBA-GEIGY Corporation, Ardsley, New York 10502.

As indicated above, full thickening power of the thickening agents used herein is realized in the absence of electrolytes. However, very small amounts of a dispersing agent or other surfactant are needed in the printing pastes of this invention in order to insure the proper wetting of the synthetic thermoplastic substrate fibers, since these fibers are hydrophobic and the printing pastes are water-based. Proper wetting of the hydrophobic fibers by the instant printing pastes is realized by inclusion in the printing paste formulation of less than 1% by weight of a non-ionic or an anionic surfactant. It is preferred to use no more than about 0.5% by weight of dispersing agent, the lower limit being determined as the least amount that will give a printing paste with satisfactory wetting power for the hydrophobic textile fibers. Exemplary or useful wetting agents for the practice of this invention are the non-ionic and anionic dispersing agents set out as emulsifiers in columns 8 and 9 of U.S. Pat. No. 3,728,087.

Examplary of the dyestuffs useful herein are the following:

| CI Disperse Yellows | CI Nos. | CI Solvent Yellows | CI Nos. |
|---|---|---|---|
| 1 | 10345 | 18 | 12740 |
| 3 | 11885 | 30 | 21240 |
| 9 | 10375 | | |
| 13 | 58900 | | |
| 16 | 12700 | | |
| 42 | 10338 | | |
| 61 | 48005 | | |
| **CI Disperse Oranges** | **CI Nos.** | **CI Solvent Oranges** | **CI Nos.** |
| 1 | 11080 | 7 | 12140 |
| 3 | 11005 | | |
| 7 | 11240 | | |
| 15 | 10350 | | |
| **CI Disperse Red** | **CI Nos.** | **CI Solvent Red** | **CI Nos.** |
| 1 | 11110 | 23 | 26100 |
| 4 | 60755 | 24 | 26105 |
| 9 | 60505 | 25 | 26110 |
| 11 | 62015 | | |
| 13 | 11115 | | |
| 15 | 60710 | | |
| **CI Disperse Blue** | **CI Nos.** | **CI Pigment Red** | **CI Nos.** |
| 3 | 61505 | 87 | 73310 |
| 5 | 62035 | | |
| 9 | 61115 | | |
| 14 | 61500 | **CI Vat Blue** | **CI Nos.** |
| 24 | 61515 | | |
| 26 | 63305 | | |
| 27 | 60767 | 1 | 73000 |
| **CI Disperse Violet** | **CI Nos.** | **CI Vat Red** | **CI Nos.** |
| 1 | 61100 | 41 | 73300 |
| 4 | 61105 | | |
| 6 | 61140 | **CI Solvent Violet** | **CI Nos.** |
| 8 | 62030 | | |
| 12 | 11120 | 13 | 60725 |

Also useful herein are the following disperse dyestuffs which do not have 5-digit CI numbers:

1. Disperse Red 60

Produced from 1-aminoanthraquinone by bromination to 1-amino 2,4-dibromoanthraquinone which is then reacted with conc. sulfuric acid to give 1-amino-2-bromo-4-hydroxyanthraquinone. This intermediate is then condensed with phenol (British Patent No. 1,090,259)

2. Disperse Blue 64

Quinizarine or 1-bromo-4-hydroxyanthraquinone is treated with p-anisidine. (U.S. Pat. No. 2,419,405; British Pat. No. 1,170,494)

3. Disperse Orange 25

N-methyl-N-cyanoethylaniline is coupled with diazotized p-nitroaniline.

In general disperse dyestuffs are useful herein, including disperse vat dyestuffs. Oil-soluble, non-ionic dyestuffs and organic pigments are included as useful herein.

The invention can be further understood in terms of the following Examples, wherein, unless otherwise stated, percents are per cent by weight, ratios are ratios by weight, and temperatures are in degrees Centigrade.

EXAMPLE 1

A dyestuff presscake with 50% solid content of a dyestuff of the following formula:

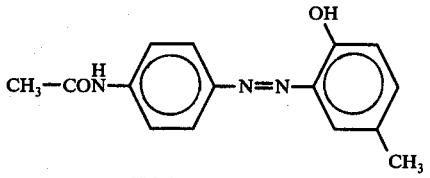

CI Disperse Yellow 3 is ball milled in water in a ratio of 20:80 for 24 hours in the presence of 0.5% of a dispersant, such as a condensation product of formaldehyde and naphthalenesulfonic acid.

A print paste is prepared by adding 3% of the above dispersion to a 0.2% solution of sodium polyacrylate of the type sold under the tradename of Carbopol (Goodrich), having a molecular weight of 3 to 4 million, the higher molecular weight being preferred.

The print paste was screen printed on polyester double knit fabric, dried 3 minutes at 105° C, and then submitted to hot air at 205° C for 60 seconds. The general fastness properties are the same as if the fabric had been after-washed and soaped. The yellow shade is fully developed.

EXAMPLE 2

The same as Example 1, but with 0.2% of a dyestuff of the following formula:

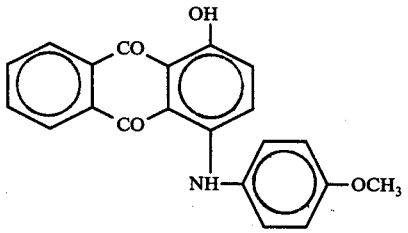

CI Disperse Blue 64 and 0.4% solution of ammonium polyacrylate of the type sold under the tradename of Carbopol (Goodrich), having a molecular weight of about 3 million.

A brilliant blue shade of excellent fastness properties is developed.

EXAMPLE 3

The same as Example 1, but the printed and dried fabric is contact heated 15 seconds at 195° C. The same brilliant shade is developed.

EXAMPLE 4

The same as Example 2, but the ammonium polyacrylate solution is substituted by 0.5% of a cross-linked ethylene maleic anhydride resin, sold under the tradename EMA 91 (Monsanto), having a viscosity of 10,000 to 100,000 cps at a concentration of 0.5 to 2% in water.

The same blue brilliant shade is obtained with overall good fastness properties.

EXAMPLE 5

The same as Example 1, but with 3% of a dyestuff of the following formula

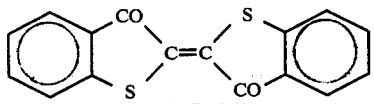

CI Vat Red 41

A brilliant, fluorescent pink with very good crock and light fastness is obtained.

EXAMPLE 6

The same as Example 3, but with a dyestuff of the following formula:

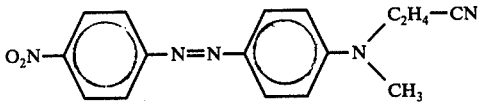

CI Disperse Orange 25

A vivid orange shade is obtained with very good fastness properties.

EXAMPLE 7

A print paste is prepared as in Example 1 but with the following dyestuff:

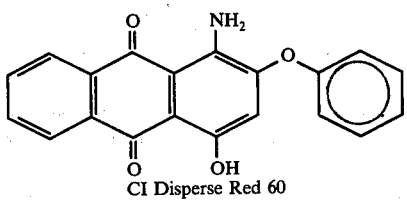

CI Disperse Red 60

A polyester double knit fabric is screen printed, dried 3 minutes at 105° C and then submitted 45 minutes to 20 psi (= 127° C) pressure steaming. A full deep pink shade is developed with very good crock and wash fastness properties. The general fastness properties are the same as if the fabric had been afterscoured and soaped.

Similar results were achieved by using HT steam (High Temperature or superheated steam) at 150° C for 8 minutes for fixing rather than the pressure steaming step described above. Both HT steaming and pressure steaming gave brighter prints than dry heat fixing described in other Examples.

EXAMPLE 8

As Example 7, but instead of polyester double knit fabric, a Nylon 66 (polyamide) fabric was printed and pressure steamed at 10 psi for 1 hour. A pink shade was obtained with generally the same fastness properties as if the fabric had been submitted to wet aftertreatment.

EXAMPLE 9

The same as Example 8, but instead of pressure steaming, the fabric was submitted to a 90 second thermosol treatment at 182° C. The same fastness properties were achieved without wet-aftertreatment, as in Example 8.

EXAMPLE 10

As Example 7, but instead of a polyester double knit fabric, a Nylon type 472 under the tradename of QIANA(R) (U.S. Pat. No. 3,393,210) was pressure steamed 1 hour at 10 psi (115° C). A full pink shade was obtained without afterscour and soaping with equal fastness properties and shade as the same print submitted to a wet-aftertreatment such as rinsing, washing and soaping.

EXAMPLE 11

The same as Example 7, but using a fabric of triacetate under the tradename of ARNEL(R) instead of polyester. The fabric was printed and submitted 1 hour to a pressure steaming of 5 psi (107° C). A full pink shade was developed with generally the same shade and fastness properties as if the fabric had been rinsed and afterwashed.

The preferred thickener is sodium polyacrylate as set out in Example 1. Similarly good results were obtained with ammonium polyacrylate, although the performance of the sodium acrylate is slightly to be preferred.

Synthetic thermoplastic textiles eligible for printing and pad dyeing by the process of this invention include particularly polyester and polyamide fibrous textiles. The process is also of use on cellulose triacetate. The preferred textile substrate is polyester material, particularly polyethylene terephthalate textiles. Modified polyester textiles are also useful herein and are intended to be included in the term polyester textiles. Textile blends of synthetic thermoplastic fibers and blends of synthetic thermoplastic fibers with cotton or wool fibers are also useful herein. Blends of such hydrophobic fibers and cotton fibers, printed by the process of this invention will generally give a heather effect inasmuch as the cellulose fibers will generally not take up the applied dye to the same extent the synthetic fibers will.

As indicated above, the unwashed prints of this invention show excellent bleed fastness, crock fastness, light fastness and wash fastness (even on first wash). As a useful variant of this process, it has been found that crock fastness of fresh print, before final heat fixation, so as to prevent accidential crocking during lay off between the printing stage and final heat fixation, can be realized by an intermediate dry heating step. Preferentially the dried textile print is immediately subjected to a dry heat treatment at 160° to 230° C for 1 to 5 seconds. Radiant heat, as by an infrared heater is preferred. Following the 1 to 5 second "flash" heat step, the printed textile is fixed by dry heat or steaming at about 120° to 230° C for a period of 5 seconds to 45 minutes. Dry heat at about 160°to 230° C for a period of 5 to 90 seconds is preferred for the final heat fixation when dry heat is used for the final fixation step. As noted in Example 7, somewhat brighter prints are obtained with steam fixation.

Any and all of the printing techniques used in textile printing with pastes are usable in this invention. For instance, the thickened printing pastes of this invention can be used in roller printing, rotary screen printing and rotagravure printing for both patterned prints and blotch prints. By blotch prints are meant over-all single-color printing of textile material.

What is claimed:

1. In a process for printing synthetic thermoplastic textiles without washing, comprising the steps of printing on the textile an aqueous dispersion of a non-ionic organic colorant, a thickener, and an effective wetting amount of a non-ionic or anionic surfactant, subsequently drying the textile, and finally heating the textile to fix the colorant, the improvement which comprises using as the thickener, about 0.05 to about 0.5% by weight of a compund of the formula

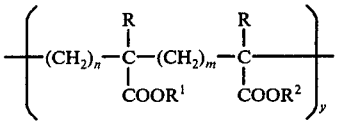

wherein

R is hydrogen or lower alkyl, $R^1$ and $R^2$ are hydrogen, sodium, potassium, ammonium, mono-lower alkyl ammonium, di-lower alkyl ammonium, tri-lower alkyl ammonium, or tetra-lower alkyl ammonium,

*m* is 0 or 1,

*n* is 2 - m, and

*y* is 5000 to 50,000, in the substantial absence of other electrolytes.

2. The process of claim 1, wherein the organic colorant is fixed in the final step by steam heat.

3. The process of claim 1, wherein m is 1, R is hydrogen, $R^1$ and $R^2$ are sodium and *y* is about 20,000.

4. The process of claim 1, wherein the thickener is 0.1 to 0.2% by weight of aqueous dispersion.

5. The process of claim 1, wherein the synthetic thermoplastic textile comprises polyester, cellulose triacetate or polyamide fibers.

6. The process of claim 5, wherein the synthetic thermoplastic textile is a polyester textile.

7. The process of claim 6, wherein the textile is a blend of polyester and cotton fibers.

8. In a process of claim 1, the further improvement of heating the textile to fix the colorant in two steps, a first step, immediately after drying, of heating the printed textile with dry heat at a temperature of 160° to 230° C for 1 to 5 seconds and a second step of subsequently heating the printed textile at 120° to 230° C for a period of 5 seconds to 45 minutes, to fully fix the printed dye on the textile.

9. The process of claim 8, wherein the second heating step is carried out with dry heat at 160° to 230° C for a period of 5 to 90 seconds.

10. Unwashed printed synthetic thermoplastic textile material consisting essentially of synthetic thermoplastic textile material bearing heat-fixed non-ionic organic colorant together with an effective printing-paste-thickening amount of a compound of the formula

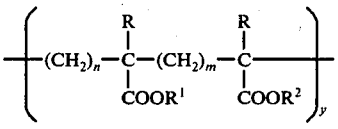

wherein

R is hydrogen or lower alkyl, $R^1$ and $R^2$ are hydrogen, sodium, potassium, ammonium, mono-lower alkyl ammonium, di-lower alkyl ammonium, tri-lower alkyl ammonium, or tetra-lower alkyl ammonium,

*m* is 0 or 1,

*n* is 2 - m, and

*y* is 5000 to 50,000, and an effective wetting amount of a non-ionic or anionic surfactant in the substantial absence of other electrolyte.

11. A printing paste, for use in producing printed synthetic thermoplastic textiles without the need for afterwashing, consisting essentially of an aqueous dispersion of a non-ionic organic colorant containing about 0.05 to 0.5% by weight of a compound of the formula

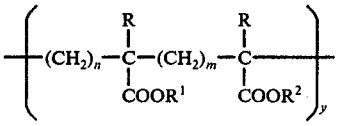

wherein

R is hydrogen or lower alkyl, $R^1$ and $R^2$ are hydrogen, sodium, potassium, ammonium, mono-lower alkyl ammonium, di-lower alkyl ammonium, tri-lower alkyl ammonium, or tetra-lower alkyl ammonium,

*m* is 0 or 1,

*n* is 2 - m, and

*y* is 5000 to 50,000, and no more than about 1% by weight of a non-ionic or anionic surfactant, in the substantial absence of other electrolyte.

12. The printing paste of claim 11, wherein the thickener is 0.1 to 0.2% by weight of the aqueous dispersion and wherein R is hydrogen, $R^1$ and $R^2$ are sodium, *m* is 1 and *y* is about 20,000.

* * * * *